US010801747B2

(12) United States Patent
Benefield et al.

(10) Patent No.: US 10,801,747 B2
(45) Date of Patent: Oct. 13, 2020

(54) ADAPTIVE MODULAR MULTICOIL HVAC SYSTEM

(71) Applicant: Scientific Environmental Design, Inc., High Point, NC (US)

(72) Inventors: Douglas Glass Benefield, Mt. Pleasant, SC (US); Justin Deshon Stabb, High Point, NC (US)

(73) Assignee: Scientific Environmental Design, Inc., High Point, NC (US)

( * ) Notice: Subject to any disclaimer, the term of this patent is extended or adjusted under 35 U.S.C. 154(b) by 9 days.

(21) Appl. No.: 16/103,771

(22) Filed: Aug. 14, 2018

(65) Prior Publication Data

US 2020/0056804 A1 Feb. 20, 2020

(51) Int. Cl.

| | |
|---|---|
| ***F24F 13/20*** | (2006.01) |
| ***F24F 13/15*** | (2006.01) |
| ***F24F 11/52*** | (2018.01) |
| ***F24F 13/28*** | (2006.01) |
| ***F24F 11/58*** | (2018.01) |
| *F24F 110/20* | (2018.01) |
| *F24F 13/14* | (2006.01) |
| *F24F 110/10* | (2018.01) |

(52) U.S. Cl.

CPC ..... *F24F 13/20* (2013.01); *F24F 11/52* (2018.01); *F24F 11/58* (2018.01); *F24F 13/15* (2013.01); *F24F 13/28* (2013.01); *F24F 2013/1433* (2013.01); *F24F 2110/10* (2018.01); *F24F 2110/20* (2018.01); *F24F 2221/36* (2013.01)

(58) Field of Classification Search

CPC .. F24F 11/52; F24F 11/58; F24F 13/15; F24F 13/20; F24F 13/28; F24F 2013/1433; F24F 2110/10; F24F 2221/36; F24F 11/74; F24F 11/77; F24F 11/80; F24F 11/81; F24F 2110/20

See application file for complete search history.

(56) References Cited

U.S. PATENT DOCUMENTS 5,277,036 A 1/1994 Dieckmann et al.
5,415,675 A * 5/1995 Powers ..... A61L 9/12 261/DIG. 88

(Continued)

*Primary Examiner* — Marc E Norman
(74) *Attorney, Agent, or Firm* — Gregory Finch; Finch Paolino, PLLC

(57) ABSTRACT

A self-contained, integrated, modular HVAC system includes a plurality of adaptive or interchangeable components or swappable modules interconnected to enable the modulation of total airflow and total cooling capacity (sensible plus latent) to meet variable loads, and adjust a sensible heat ratio (SHR) to meet a variable latent ratio of a conditioned space. The components comprise one or more air inlet, damper, inlet damper, air filtration module, air purification module, air freshener module, dehumidifying module, cooling module, air bypass module, blower module, air outlet, I/O panel, and a control cabinet. The components have sensors and actuators that allows a programmable control system to coordinate diagnostics and operations of internal and external components of a refrigeration/heating cycle using various feedback control logics. The HVAC system allows users to remotely determine a chosen relative humidity (RH) set-point, airflow, and temperature of a conditioned space using wireless data communication devices.

20 Claims, 11 Drawing Sheets

(56) References Cited

U.S. PATENT DOCUMENTS

| | | | | |
|---|---|---|---|---|
| 5,485,878 | A | 1/1996 | Derks | |
| 6,055,818 | A * | 5/2000 | Valle | F24D 19/1039 62/173 |
| 6,253,560 | B1 * | 7/2001 | Cava | B60H 1/3227 165/104.14 |
| 2007/0228183 | A1 * | 10/2007 | Kennedy | F24F 11/30 236/1 C |
| 2010/0082162 | A1 * | 4/2010 | Mundy | F24F 3/044 700/277 |
| 2013/0182364 | A1 * | 7/2013 | Abate | F24F 3/166 361/231 |

* cited by examiner

ADAPTIVE MODULAR MULTICOIL HVAC SYSTEM

FIELD

The present disclosure relates to the field of heating ventilation and air conditioning (HVAC) systems; particularly, a next generation integrated, adaptive, and modular HVAC system for improved energy efficiency, performance, comfort and air quality, and sustainability incorporating feedback control automation and mobile connectivity.

BACKGROUND

An HVAC system is the primary platform for providing steady-state thermal comfort and acceptable indoor air quality (IAQ) in residential homes and commercial structures. HVAC systems are well known in the prior art, and function to selectively circulate conditioned air throughout a home or structure according to feedback from a thermostat. When engaged in a cooling mode, a conventional HVAC unit passes air typically over a single cooling evaporator coil and discharges conditioned air throughout the structure via ductwork until a desired temperature is reached. Flowing air over the cooling coil also functions to dehumidify the passing air. The dehumidification effectiveness of an HVAC system is commonly characterized by the sensible heat ratio (SHR), which is the ratio of sensible cooling capacity to the total (sensible plus latent (water vapor)) cooling capacity. Reducing the SHR increases the portion of the total cooling capacity for providing dehumidification. In practice, most residential air conditioners are designed to cycle on and off in response to the cooling required by the occupants. When the temperature of the air in the structure reaches a desired temperature on the thermostat, the unit shuts down until cool air is needed again. However, smart thermostats have been introduced to improve the process with the aim to enhance energy efficiency.

With the rising cost of energy, many homeowners appreciate the benefits of owning an energy efficient home and appliances. An emphasis on energy efficiency can be found in every aspect of the home environment. The addition of energy-efficient windows and insulation to a home have decreased greatly the heating and cooling loads. Retrofit measures and new construction practices are growing to achieve lower infiltration levels under increasingly tighter envelopes. Current best practice strives to make homes as airtight as possible using methods such as controlled ventilation, mechanical systems, and energy recovering ventilation (ERV). Air sealing and air-tight construction have been proven to be able to provide substantial energy reductions often at the cost of low airflow and ventilation. A key barrier to implementation of these approaches is the potential impact on IAQ. Residential IAQ can be adversely affected by volatile organic compounds (VOCs) that are emitted by various sources in homes. Mechanical ventilation can provide acceptable IAQ but at an energy cost. Pollutant source control, active ventilation via sensor diagnostics (e.g., monitoring CO2 levels), and ERVs are methods implemented to reduce the associated ventilation energy and cost penalty for a home. However, the potential benefits of air sealing and the costs of ventilation vary widely: across individual homes; sub-populations by climate; baseline air-tightness and structural characteristics; the performance characteristics of existing or replacement HVAC equipment; and the occupant-influenced appliance operational schedules and settings.

In hot and humid climates, the use of air conditioning systems account for a significant amount (approximately 10%) of the total energy consumed in the residential sector. Numerous attempts have been made in the prior art to improve the energy efficiency of HVAC systems. Over the years, HVAC units have become more efficient to meet the requirements of an efficiency standards agreement signed by leading manufacturers and advocacy organizations (e.g., AHRI, ACEEE, Alliance, NRDC, NEEP, ASAP, CEC) to established new federal standards. Under the agreement, the U.S. is divided into three regions defined by population-weighted heating degree days (HDD) equal or greater than 5000. The agreement allows the US Department of Energy (DOE) to use more than one efficient metric for a product. Common air conditioning performance metrics include the energy efficiency ratio (EER), sensible heat ratio-factor (SHR), and the Seasonal Energy Efficient Ratio (SEER). The EER is a simple metric that represents the ratio between BTU per output in cooling and the input power that can be used to compare approximate energy usage between systems. EER has two main inputs: output cooling energy (in Btu/hr.) and; the input electrical energy (in Watts), as measured at 95° F. outdoor (and 80° F. dry-bulb, 67° F. wet-bulb indoor temperatures). The SEER is a seasonal adjustment applied to EER agreed by manufacturers of residential split units and the higher the number the more efficient the unit rating or ranking. System efficiency (SEER) has two important inputs: steady state efficiency ($EER_B$), as measured at the DOE "B" conditions (82° F. outdoor) and; the cyclic degradation factor (Cd) as calculated from the DOE "C and D" tests. SEER is calculated using the following formula: $SEER=EER_B*(1-Cd/2)$.

The energy federal standards have set the minimum residential air conditioner (AC) unit requirements to at least SEER 13. However, the new agreement has raised the bar, for example, with central air conditioners in the South regions required to have a SEER of 14. System redesigns are underway to address these efficiency standards. These include the incorporation of advanced variable-speed (VS) (i.e., inverter) compressor technology within condensing units in air conditioners and heat pumps. Inverter allows for varying the compressor rotation frequency to change flow rate at constant compression ratio and, therefore, at constant volumetric and isentropic efficiencies. However, inverters still contribute to energy loss due to the required voltage-current conversions for operation. The availability of VS systems has also lead to discrepancies with the system ranking between constant speed and variable speed systems when using cyclic testing to determine accurately the EER and SEER metrics for sensible capacity. It has been determined that the cyclic performances of the different systems at wet and dry single coil conditions are not equivalent. The EER ratio at dry coil conditions are higher than at wet coil conditions for both systems. Subsequently, the SEER based on the wet coil cyclic test is lower than the SEER based on the dry coil cyclic test, effecting the relative ranking among the two systems (Henderson, H. I., "An Experimental Investigation of the Effects of Wet and Dry Coil Conditions on Cyclic Performance in the SEER Procedure" (1990). International Refrigeration and Air Conditioning Conference. Paper 83.). This is a conundrum facing the industry under the constraint of using a single set of cooling coil with a single source of constant airflow.

The evaporator coil plays an important role in the reliability and performance of a conventional split system residential AC system. The performance is highly dependent on the optimal air flow rate across the evaporator coil, affecting both the sensible and latent cooling capacities, to achieve a balance between sensible heat transfer and moisture removal, ultimately impacting the overall system efficiency. Excessive coil air flow requires or draws more fan power from the blower and can compromise air moisture removal or dehumidification. As such, the amount of airflow moving across the indoor coil is critical for dehumidification. However, if flow is too low, cooling is reduced resulting in a degradation of cooling system EER. Very low air flow may lead to evaporator coil icing, "freeze up," refrigerant flood back, compressor failure, structure interior mold issues, and ultimately IAQ. Air flow bypasses, dampers, air filters, and air purifiers have been implemented in various configurations to address some of these issues.

HVAC consumers desire both low energy costs and improved moisture removal in the conditioned space that meet the regional efficiency standards. As homes become more energy efficient, the latent load (water vapor) can be a large fraction of the total cooling load, especially with the introduction of high ventilation rates to address IAQ. The challenge for meeting the needs of energy efficient homes is to address both sensible and latent loads efficiently and effectively by controlling and optimizing the total airflow within a residential home or commercial structure under the constraints of variable physical characteristics (e.g., size, number of ducts, etc.), HVAC equipment sizes, disparate HVAC system components, component matching requirements, disparate operating fans, dampers, inverters, ventilators, and ERVs.

The overall performance of an AC system depends strongly on the entire system as well as the performance of its individual and currently disparate components (e.g., evaporator coil, compressor, fans, etc.). The proper matching of the outdoor condensing unit to the indoor components is necessary to ensure that the complete system delivers on performances and value. Conventional AC systems are sized to meet peak cooling events and therefore are substantially oversized for most time of the year. Oversizing AC equipment increases the amount of time spend at part load and results in high space humidity levels. The customer requirements can be addressed by sizing the proper equipment to produce suitably long duty cycle run-times for effective moisture removal, choice of equipment with low SHR and proper evaporator air flow to produce the rated efficiency. Continuous fan operation is also becoming prevalent for residential applications for a variety of reasons including air filtration and new recommendations for whole-building ventilation. Proper duct design to reduce system static pressure can reduce fan speed energy and improve overall system EER. In a typical residence, fixed capacity AC system, avoiding oversizing, can generally provide good relative humidity (RH) control. However, in low-load homes, these systems may be less effective in achieving a desired RH. In addition, very low loads can lead to inadequate airflow affecting IAQ and potentially the health of occupants.

Therefore, the need exists for a next generation integrated and modular HVAC system, having the flexibility from interchangeable and modular components (e.g., coil, damper, etc.), that enables the modulation of the total capacity (sensible plus latent) to meet variable loads and to adjust SHR to meet a variable latent ratio of a conditioned space. The system should be able to modulate airflow in response to a RH-set point, adjusting airflow to achieve low SHR values, and ideally have a low impact on IAQ.

Through applied effort, ingenuity, and innovation, Applicant has identified deficiencies and problems with existing HVAC systems that are constrained by complexity, factors, and limitations such as size, fixed capacity, single coil, fixed airflow, power source and requirements, voltage-current conversion for inverters and fans, and the need to mix and match disparate components, leading to energy inefficiency. Applicant has developed a solution that is embodied by the present invention, which is described in detail below.

SUMMARY

The following presents a simplified summary of some embodiments of the invention to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

An object of the present disclosure is a self-contained, integrated, and modular HVAC system comprising one or more air inlet, inlet damper, air filtration module, air purification module, air freshener module, dehumidifying coil, dehumidifying coil damper, cooling coil, coil damper, bypass air damper, blower module, air outlet, and a control cabinet. In various embodiments, the dehumidifying coil, dehumidifying coil damper, cooling coil, coil damper, and bypass air damper operate independently. In various embodiments, the said dehumidifying coil and dehumidifying coil damper are contained and operate together within an insertable-removable module ("dehumidifying"), the said cooling coil and coil damper are contained and operate together within an insertable-removable module ("cooling"), and the bypass air damper is contained and operate within an insertable-removable module ("bypass air damper"). The individual modules are insertable-removable into and out of one or more designated slot, rack, space, location, or the like within the modular HVAC unit. The individual modules can be serially connected to one another or may be arranged to function in parallel to facilitate airflow, into, through, within, or out of their inlet or outlet port, structure, or the like, dependent on their individual function. The components are configured to operate as an inter-connected modular system enabling the modulation of the total cooling capacity (sensible plus latent) to meet variable loads and to adjust SHR to meet a variable latent ratio of a conditioned space. In a preferred embodiment, the system modulates the total airflow in response to a relative humidity (RH)-set point of said conditioned space. In another preferred embodiment, the system enables the adjustment of airflow to achieve low sensible heat ratio (SHR) values of said condition space. In various embodiments, the said modules are exchangeable to meet a desired airflow capacity requirement or enable performance matching with one or more internal or external compressor, inverter, condenser, valve, thermostatic valve, electronic expansion valve, fan, pump, or the like components of an AC thermodynamic circuit. In various embodiments, the said modules contain sensors and actuators to enable feedback control by one or more system logic controller. In various embodiments, the modular HVAC unit operates under a programmable master controller allowing a user to determine a chosen RH set-point, airflow, temperature, or the like, of a conditioned space.

An object of the present disclosure is a self-contained, integrated, and modular HVAC system comprising an outside air inlet having an air inlet damper operating in conjunction with one or more adaptive or interchangeable components to maintain an appropriate calculated airflow through a conditioned space while controlling the airflow over one or more coil within said dehumidification module or said cooling module, or combination thereof, to achieve an optimal sensible BTU rate for energy efficiency. The adaptive or interchangeable components include, but not limited to one or more said, air filtration module, air purification module, air freshener module, dehumidifying module, cooling module, bypass air damper module, blower module, air outlet. In various embodiments, the air inlet damper comprises sensors and actuators to enable feedback control by a system logic controller.

An object of the present disclosure is a self-contained, integrated, and modular HVAC system comprising a return air inlet operating in conjunction with one or more adaptive or interchangeable components to maintain an appropriate calculated airflow through the conditioned space while controlling the airflow over one or more cooling coil within said dehumidification module and said cooling module, to achieve an optimal sensible BTU rate for energy efficiency. The adaptive or interchangeable components include, but not limited to one or more said, air filtration module, air purification module, air freshener dispensing module, dehumidifying module, cooling module, bypass air damper module, blower module, air outlet.

An object of the present disclosure is a self-contained, integrated, and modular HVAC system comprising an air filtration unit operating in conjunction with one or more adaptive or interchangeable components. The adaptive or interchangeable components include, but not limited to one or more said, outside air inlet, outside air inlet damper, return air inlet, air purification module, air freshener module, dehumidifying module, cooling module, bypass air damper module, blower module. In various embodiments, the air filtration module comprises a passive filter unit, mechanical filter, polymeric filter, an active filter unit, an active filter unit having sensor and actuators to enable feedback control by a system controller, the like, or combinations thereof. In various embodiments, the filtration module filters the air flowing into, within, through, or air exiting the HVAC system of infiltrates, VOCs, noxious gas, radon, carbon monoxide, carbon dioxide, particles, pathogens, bacteria, mold, fungi, virus, or the like.

An object of the present disclosure is a self-contained, integrated, and modular HVAC system comprising an air purification module operating in conjunction with one or more adaptive or interchangeable components. The adaptive or interchangeable components include, but not limited to one or more said, outside air inlet, outside air inlet damper, return air inlet, air filtration module, air freshener module, dehumidifying module, cooling module, bypass air damper module, blower module, air outlet. In various embodiments, the air purification module comprises a passive purification unit, an active purification unit, an active purification unit having sensors and actuators to enable feedback control by a system controller, or combinations thereof. In various embodiment, the active purification unit contains emitters capable of emitting non-ionizing or ionizing radiation, electromagnetic radiation, ultrasound, chemical, sono-chemical, gas, mists, photo-ionizing radiation, the like, or combinations thereof, to disinfect the air flowing into, within, through, or air exiting the HVAC unit. In various embodiments, the emitters contain sensors and actuators to enable feedback control by a system controller. In various embodiments, the purification unit neutralizes or cleans the said air of infiltrates, VOCs, noxious gas, radon, carbon monoxide, carbon dioxide, pathogens, bacteria, mold, fungi, virus, or the like.

An object of the present disclosure is a self-contained, integrated, and modular HVAC system comprising an air freshener module operating in conjunction with one or more adaptive or interchangeable components. The adaptive or interchangeable components include, but not limited to one or more said, outside air inlet, outside air inlet damper, return air inlet, air filtration module, air purification module, dehumidifying module, cooling module, bypass air damper module, blower module, air outlet. In various embodiments, the air freshener module comprises a passive scent unit, a replaceable scent cartridge, an active scent dispensing unit, an active scent dispensing unit having sensors and actuators (e.g., gas cylinder, propellant) to enable feedback control by a system controller, or combinations thereof. In various embodiment, the active air freshener unit dispenses one or more scents, from one or more, scent source, replaceable scent cartridge, into the air flowing into, within, through, or air exiting the HVAC unit. In various embodiments, the scent source and propelling unit contain sensors and actuators to enable feedback control by a system controller. In various embodiments, the air freshening unit affects the said air, air odor, or the like, to improve IAQ.

An object of the present disclosure is a self-contained, integrated, and modular HVAC system comprising a dehumidification module operating in conjunction with one or more adaptive or interchangeable components to change or maintain humidity (RH) in the conditioned space at a desired level. The adaptive or interchangeable components include, but not limited to one or more said, outside air inlet, outside air inlet damper, return air inlet, air filtration module, air freshener module, cooling module, bypass air damper module, blower module, air outlet. In various embodiments, the dehumidification module contains sensors (e.g., temperature, pressure, humidity, position, etc.) and actuators (e.g., motors) to enable feedback control by a local logic controller, a programmable master system controller, or the like. In various embodiments, the said modules are exchangeable to meet a desired airflow capacity requirement or enable performance matching with one or more internal or external compressor, inverter, condenser, valve, thermostatic valve, electronic expansion valve, fan, pump, heat pump, or the like components of an AC thermodynamic circuit. In various embodiment, the dehumidifying coil and damper operate together under feedback control enabling variable damper position, angle, rotation, to control volumetric airflow over the dehumidification coil.

An object of the present disclosure is a self-contained, integrated, and modular HVAC system comprising a cooling module, functioning to modulate the temperature of the airflow, operating in conjunction with one or more adaptive or interchangeable components to establish a specified total cooling capacity (sensible plus latent) to meet variable loads, or to adjust SHR to meet a variable latent ratio, or change or maintain humidity (RH) of a conditioned space. The adaptive or interchangeable components include, but not limited to one or more said, outside air inlet, outside air inlet damper, return air inlet, air filtration module, air freshener module, dehumidification module, bypass air damper module, blower module, air outlet. In various embodiments, the cooling module contains sensors (e.g., temperature, pressure, humidity, position, etc.) and actuators (e.g., motors) to enable feedback control by a local logic controller, a programmable master system controller, or the like. In various embodiments, the said modules are exchangeable to meet a desired airflow capacity requirement or enable performance matching with one or more internal or external compressor, inverter, condenser, valve, thermostatic valve, electronic expansion valve, fan, pump, or the like components of an AC thermodynamic circuit. In various embodiment, the cooling coil and damper operate together under feedback control enabling variable damper position, angle, rotation, to control volumetric airflow over the cooling coil.

An object of the present disclosure is a self-contained, integrated, and modular HVAC system comprising a bypass air damper module, functioning to modulate the temperature of the airflow, operating in conjunction with one or more adaptive or interchangeable components to establish a specified total cooling capacity (sensible plus latent) to meet variable loads, or to adjust SHR to meet a variable latent ratio, or change or maintain humidity (RH) of a conditioned space. The adaptive or interchangeable components include, but not limited to one or more said, outside air inlet, outside air inlet damper, return air inlet, air filtration module, air freshener module, dehumidification module, cooling module, blower module, air outlet. In various embodiments, the said modules are exchangeable to meet a desired airflow capacity requirement or enable performance matching with one or more internal or external compressor, inverter, condenser, valve, thermostatic valve, electronic expansion valve, fan, pump, or the like components of an AC thermodynamic circuit. In various embodiments, the cooling module contains sensors (e.g., temperature, pressure, humidity, position, etc.) and actuators (e.g., motors) to enable feedback control by a local logic controller, a programmable master system controller, or the like. In various embodiment, the cooling coil and damper operate together under feedback control enabling variable damper position, angle, rotation, to control volumetric airflow within the HVAC unit.

An object of the present disclosure is a self-contained, integrated, and modular HVAC system comprising air blower module operating in conjunction with one or more adaptive or interchangeable components of said modular HVAC system. The adaptive or interchangeable components include, but not limited to one or more said, outside air inlet, outside air inlet damper, return air inlet, air filtration module, air freshener module, dehumidification module, cooling module, air outlet. In various embodiments, the blower module contains sensors (e.g., temperature, pressure, humidity, position, etc.) and actuators (e.g., motors) to enable feedback control by a local logic controller, a programmable master system controller, or the like. In various embodiments, the said module is exchangeable to meet a desired airflow capacity requirement or enable performance matching with one or more internal or external compressor, inverter, condenser, valve, thermostatic valve, electronic expansion valve, fan, pump, or the like components of an AC thermodynamic circuit. In various embodiment, the blower module and one or more said adaptive or interchangeable components operate together under feedback control enabling variable operation, to control volumetric airflow from within the modular HVAC unit through the air outlet of the unit into the conditioned space.

An object of the present disclosure is a self-contained, integrated, and modular HVAC system comprising an access panel, located at a defined interior portion of a wall of the unit, containing one or more I/O interfaces (e.g., male/female plugs, other plugs, etc.), including but not limited to, a water inlet, water discharge, refrigerant inlet/out lines, and power input. The I/O interface panel is accessible from the exterior of the unit through a hinged articulating hatch door. The I/O interface enables the required connections to complete a HVAC circuit for water and refrigerant and power for operating one or more said adaptive or interchangeable components, modules, or sub-unit, sensor, actuator, damper, blower, or the like.

An object of the present disclosure is a self-contained, integrated, and modular HVAC system comprising electronic hardware to enable the system, said adaptive or interchangeable components, modules, or sub-unit, sensor, actuator (e.g., motor), damper, blower, or the like, to operate under variable speed drive (VSD), whereby the speed of one or more actuator or motor is regulated to match its speed with a related or total conditioned space load requirement via a VSD system. In various embodiments, the said VSD system comprises one or more said motor operating under direct current (DC) from power supply sources including but not limited to HVDC, photo-voltaic, solar panels, batteries, or the like. In various embodiments, the said HVAC system incorporates analog or digital circuits to enable variable speed, linear or rotation, operation of actuators, motors, or inverters with the goal to enhance energy efficiency.

An object of the present disclosure is a self-contained, integrated, and modular HVAC system having a control cabinet comprising an electronic control system. The electronic control system comprises hardware and software components configured to enable feedback control, as a master programmable controller, one or more motorized damper, coil, module, air filtration module, a purification module, dehumidification module, cooling module, bypass air damper module, and blower, external or internal compressor, inverter, valve, thermostatic valve, electronic expansion valve, or the like, using one or more sensor and actuator. In various embodiments, the electronic control system controls the operation of external components (e.g., inverter, compressor, valve, etc.) in conjunction with the components the modular HVAC system. In various embodiments, the feedback control logic or methods employed include, but not limited to, classic, modern, and intelligent methods. In various embodiments, the classic methods include on-off, proportional-integral (PI), proportional-integral-derivative (PDI), or the like. In various embodiments, the classic methods include adaptive and optimal, or the like. In various embodiments, the intelligent methods include fuzzy logic and neural network, or the like. In various embodiments, the method is a stochastic optimal control method or the like. In various embodiments, the method is a nonlinear and adaptive control method or the like. In various embodiments, the method is a modern MIMO (multiple input-multiple output) control method. In a preferred embodiment, the electronic control system enables the modulation of the total cooling capacity (sensible plus latent) to meet variable loads and to adjust SHR to meet a variable latent ratio of a conditioned space. In another preferred embodiment, the electronic system modulates the total airflow in response to a relative humidity (RH)-set point of said conditioned space. In yet another preferred embodiment, the system enables the adjustment of airflow to achieve low sensible heat ratio (SHR) values of said condition space.

An object of the present disclosure is a self-contained, integrated, and modular HVAC system having a control cabinet comprising an electronic control system. The electronic control system comprises hardware and software components configured to enable diagnostic feedback from one or more motorized damper, coil, module, air filtration module, air purification module, air freshener module, dehumidification module, cooling module, bypass air damper module, and blower module, external or internal compressor, inverter, valve, thermostatic valve, electronic expansion valve, or the like, using one or more diagnostic sensor. In various embodiments, the electronic control system enables the monitoring of one or more said device to determine operating parameters, set operating parameter, configure functions, for trouble-shooting, setting alerts, determine operating efficiency, tuning, or the like.

An object of the present disclosure is a self-contained, integrated, and modular HVAC system having a control cabinet comprising an electronic control system comprising an electronic data communication module. The communication module contains one or more electronic components, including a wireless transceiver, to enable the transmission or reception of data from an internal or external/remote controller; sensor, actuator, compressor, pump, valve, thermostatic valve, electronic expansion valve, inverter, fan, blower, a remote thermostat, computer, laptop, computing mobile device, mobile phone, cloud server, or the like.

An object of the present disclosure is a self-contained, integrated, and modular HVAC system with a control system that accepts on or more input relating to the environment settings of a condition space from an external, remote, or wireless controller. The said controller may include but not limited to a, thermostat, smart thermostat, a smart environment controller, hand-held controller, computing device, computer, laptop, computing mobile device, mobile phone, smart mobile phone, cloud server, or the like. In various embodiments, the controller provide computing memory storable options for configuring the conditioned space with the non-limiting following parameters: temperature, humidity (RH), airflow, operation schedule (e.g., time of the day, duration of operation), efficiency setting, scent-type, scent cartridge, filtration unit operation schedule, purification unit operation schedule, system diagnostic parameters, component information (e.g., brand, manufacturer, operational parameters, etc.), or the like. In various embodiments, the inputs for the environment settings may be sent to the HVAC control system using a computing application software. In various embodiment, the application software may execute its instructions on a computing system, a computing device, computer, laptop, computing mobile device, mobile phone, smart mobile phone, mobile app, cloud server, or the like. In various embodiments, the said control system may communicate and function with external environment management control system.

Specific embodiments of the present disclosure provide for an adaptive modular HVAC system comprising a housing having a first compartment, a second compartment, and an interface extending between the first compartment and the second compartment, the first compartment defining a return air plenum and the second compartment defining a supply air plenum; a cooling module removably coupled to a first portion of the interface, the cooling module defining a first airflow path, the cooling module having a first cooling coil and a first motorized damper; a dehumidification module removably coupled to a second portion of the interface, the dehumidification module defining a second airflow path, the dehumidification module having a second cooling coil and a second motorized damper; an airflow bypass module removably coupled to a third portion of the interface, the airflow bypass module defining a third airflow path, the airflow bypass module having a third motorized damper; and, a blower coupled to an upper portion of the second compartment of the housing.

Further specific embodiments of the present disclosure provide for an adaptive modular HVAC system comprising a housing having a first compartment, a second compartment, and an interface extending between the first compartment and the second compartment, the first compartment defining a return air plenum and the second compartment defining a supply air plenum; a cooling module removably coupled to a first portion of the interface, the cooling module defining a first airflow path, the cooling module having a first cooling coil and a first motorized damper; a dehumidification module removably coupled to a second portion of the interface, the dehumidification module defining a second airflow path, the dehumidification module having a second cooling coil and a second motorized damper; an airflow bypass module removably coupled to a third portion of the interface, the airflow bypass module defining a third airflow path, the airflow bypass module having a third motorized damper; and, a blower coupled to an upper portion of the second compartment of the housing, the blower comprising a variable speed drive, the variable speed drive comprising an electric motor, a power inverter, and a controller, the controller being configured to dynamically regulate an electrical current to the electric motor.

Still further specific embodiments of the present disclosure provide for an adaptive modular HVAC system comprising a housing having a first compartment, a second compartment, and an interface extending between the first compartment and the second compartment, the first compartment defining a return air plenum and the second compartment defining a supply air plenum; a cooling module removably coupled to a first portion of the interface, the cooling module defining a first airflow path, the cooling module having a first cooling coil and a first motorized damper; a dehumidification module removably coupled to a second portion of the interface, the dehumidification module defining a second airflow path, the dehumidification module having a second cooling coil and a second motorized damper; an airflow bypass module removably coupled to a third portion of the interface, the airflow bypass module defining a third airflow path, the airflow bypass module having a third motorized damper; a blower coupled to an upper portion of the second compartment of the housing, the blower comprising a first variable speed drive, the first variable speed drive being configured to dynamically regulate an electrical current to the electric motor; a compressor unit operably engaged with the first cooling coil and the second cooling coil, the compressor unit comprising a compressor, a condenser, a second variable speed drive, and a thermal expansion valve, the second variable speed drive being configured to dynamically regulate an electrical current to the compressor; a plurality of sensors comprising at least one temperature sensor and at least one humidity sensor; and, a controller, the controller being operably engaged with the first motorized damper, the second motorized damper, the third motorized damper, and the blower, and being configured to receive a data input from the plurality of sensors, the controller being comprised of one or more processors, and a non-transitory computer readable medium having stored thereon a set of instructions being programmable by a user and executable by the at least one of the one or more processors, to cause the at least one of the one or more processors to perform one or more operations, the set of instructions comprising instructions for modulating the position of the first motorized damper in response to a data input from the temperature sensor; instructions for modulating the position of the second motorized damper in response to a data input from the humidity sensor; instructions for modulating the position of the third motorized damper in response to a data input from the temperature sensor and humidity sensor; and, instructions for dynamically regulating the first variable speed drive and the second variable speed drive.

The foregoing has outlined rather broadly the more pertinent and important features of the present invention so that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent structures do not depart from the spirit and scope of the invention as set forth in the appended claims.

BRIEF DESCRIPTION OF DRAWINGS

The above and other objects, features, and advantages of the present disclosure will be more apparent from the following detailed description taken in conjunction with the accompanying drawings, in which.

DETAILED DESCRIPTION

Figure 1:
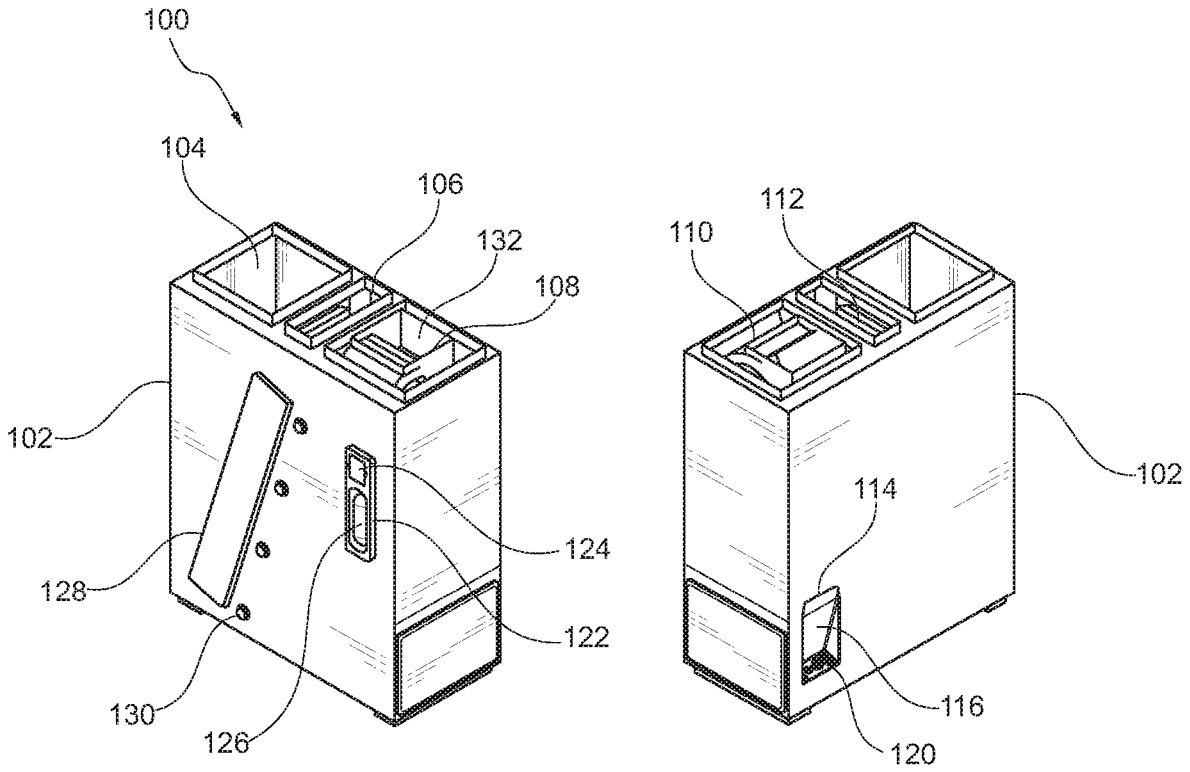
FIG. 1 is a functional diagram of a next generation, integrated, and modular HVAC unit, according to an embodiment of the present disclosure.

Exemplary embodiments are described herein to provide a detailed description of the present disclosure. Variations of these embodiments will be apparent to those of skill in the art. Moreover, certain terminology is used in the following description for convenience only and is not limiting. For example, the words "right," "left," "top," "bottom," "upper," "lower," "inner" and "outer" designate directions in the drawings to which reference is made. The word "a" is defined to mean "at least one." The terminology includes the words above specifically mentioned, derivatives thereof, and words of similar import.

Embodiments of the present disclosure provide for a next generation, integrated, and modular HVAC system. Embodiments of the present disclosure solve problems associated with prior art HVAC systems that enable the modulation of the total capacity (sensible plus latent) to meet variable loads and to adjust SHR to meet a variable latent ratio of a conditioned space, including: complexity, factors, and limitations such as size, fixed volume capacity, single coil, fixed airflow, power source and requirements, voltage-current conversion for inverters and fans, and the need to mix and match disparate components from various manufacturers, leading to energy inefficiency. In addition, in low-load conditioned spaces, the prior art systems may be less effective in achieving a desired RH. These very low load settings can lead to inadequate airflow with a conditioned space affecting IAQ and potentially the health of occupants.

According to various embodiments of the present disclosure, the complexity, factors and limitations of prior art HVAC systems are solved with a self-contained, integrated, and modular HVAC system comprising one or more air inlet, inlet damper, air filtration module, air purification module, air freshener module, dehumidifying coil, dehumidifying coil damper, cooling coil, coil damper, bypass air damper, blower module, air outlet, and a control cabinet. In an embodiment, the dehumidifying coil, dehumidifying coil damper, cooling coil, coil damper, and bypass air damper operate independently. In an embodiment, the said dehumidifying coil and dehumidifying coil damper are contained and operate together within an insertable-removable module ("dehumidifying"), the said cooling coil and coil damper are contained and operate together within an insertable-removable module ("cooling"), and the bypass air damper is contained and operate within an insertable-removable module ("bypass air damper"). The individual modules are insertable-removable (e.g., swappable, plug-and-play, etc.) into and out of one or more designated slot, rack, chassis, space, location, or the like within the modular HVAC unit. The individual modules can be serially connected to one another or may be arranged to function in parallel to facilitate airflow, into, through, within, or out of their inlet or outlet port, structure, or the like, dependent on their individual function. The components are configured to operate as an inter-connected modular system enabling the modulation of the total cooling capacity (sensible plus latent) to meet variable loads and to adjust SHR to meet a variable latent ratio of a conditioned space. In a preferred embodiment, the system modulates the total airflow in response to a relative humidity (RH)-set point of said conditioned space. In another preferred embodiment, the system enables the adjustment of airflow to achieve low sensible heat ratio (SHR) values of said condition space. In an embodiment, the said modules are exchangeable to meet a desired airflow capacity requirement or enable performance matching with one or more internal or external compressor, inverter, condenser, valve, thermostatic valve, electronic expansion valve, fan, pump, heat pump, or the like components of an AC thermodynamic circuit. In various embodiments, the said modules contain sensors and actuators to enable feedback control by one or more system logic controller. In another embodiment, the modular HVAC unit operates under a programmable master controller allowing a user to determine a chosen RH set-point, airflow, temperature, or the like, of a condition space.

Referring now to FIG. 1, a functional diagram of an adaptive modular HVAC system 100 is shown. HVAC system 100 comprises a portable and integrated HVAC unit 102 from two differing aspects highlighting several distinguishing design features and components. The top of HVAC unit 102 comprises a return air inlet 104, outside air inlet 106, conditioned air outlet module 108, blower fan 110, outside air inlet damper 112, and air outlet 132. On one side of HVAC unit 102, a recess 114 can be seen with a push-able hinged articulating door 116 revealing an internal input/output panel 120. On another side of HVAC unit 102 contains an air freshener module 122 having a scent cartridge 124 coupled to an air-powered active scent dispensing unit 126. The placements of an air filtration module 128 and a purification module 130 within HVAC unit 102 can be observed with system 100. In various embodiments, HVAC unit 102 comprises adaptive or interchangeable components including, but not limited to one or more, return air inlet 104, outside air inlet 106, blower module 108, blower fan 110, outside air inlet damper 112, air freshener module 122, air filtration module 128, air purification module 130, dehumidifying module, cooling module, bypass air damper module, and air outlet 132. In various embodiments, air blower module 108 operates in conjunction with one or more said adaptive or interchangeable components of said modular HVAC system. In various embodiments, the blower module 108 contains sensors (e.g., temperature, pressure, humidity, position, etc.) and actuators (e.g., motors) to enable feedback control by a local logic controller, a programmable master system controller, or the like. In various embodiments, the said module 108 is exchangeable to meet a desired airflow capacity requirement or enable performance matching with one or more internal or external compressor, inverter, condenser, valve, thermostatic valve, electronic expansion valve, fan, pump, or the like components of an AC thermodynamic circuit. In various embodiment, the blower and one or more said adaptive or interchangeable components operate together under feedback control enabling variable operation, to control volumetric airflow from within the modular HVAC unit 102 through the air outlet of the unit into the conditioned space.

Figure 2:
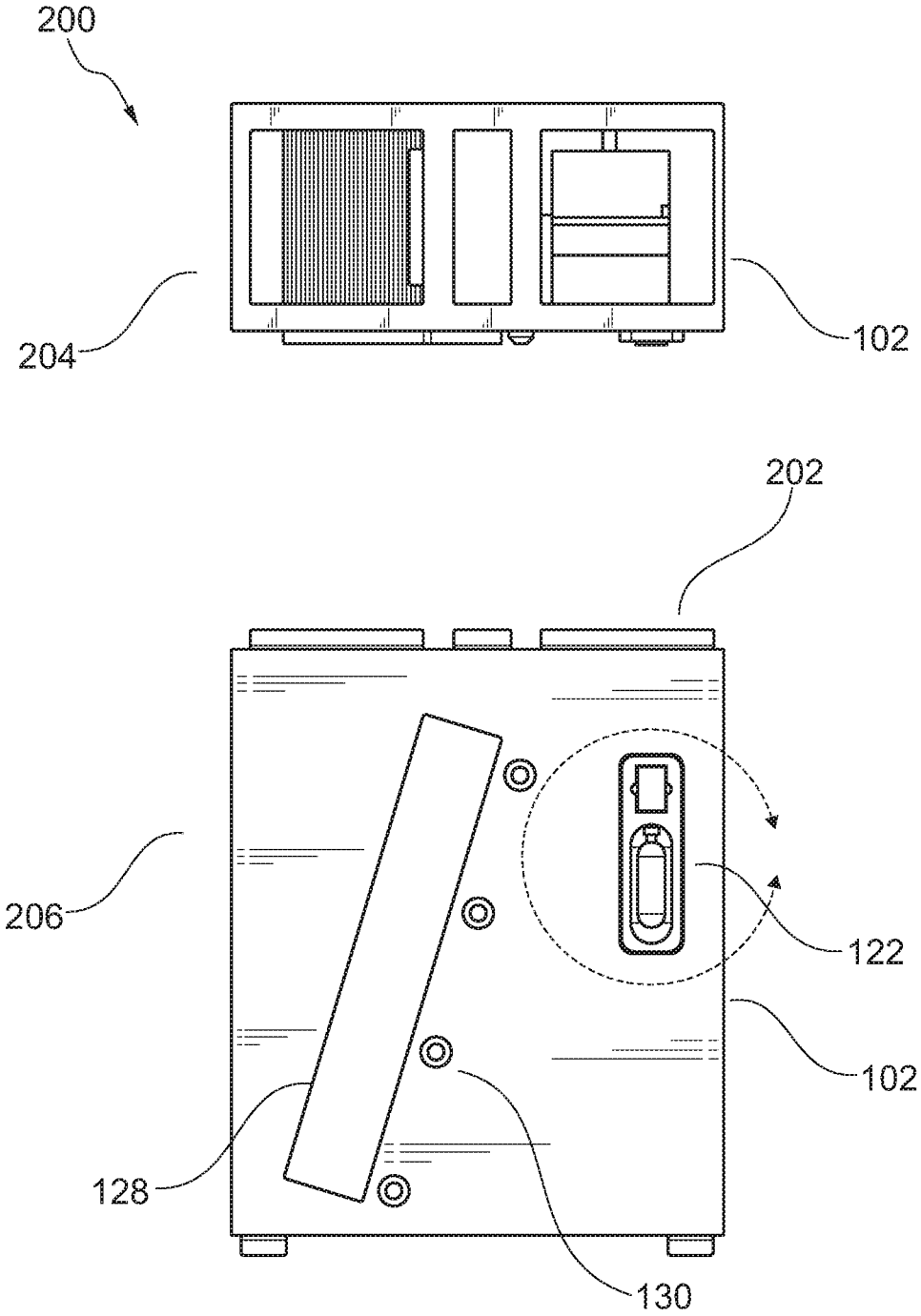
FIG. 2 is a functional diagram showing a top-view and side-view of the HVAC unit, according to an embodiment.

Referring now to FIG. 2, a functional diagram of an HVAC system 100 shows a top-view and side-view of HVAC unit 102. HVAC unit 102 has a length dimension 202, a width dimension 204, and a height dimension 206. In one non-limiting embodiment, HVAC unit 102 has a length dimension 202 of 50.5 inches, with dimension 204 of 24 inches, and a height dimension of 64.5 inches. HVAC unit 102 may have alternative dimensions dependent on addition or subtraction of internal and external components, or available floor space for placement of unit. HVAC unit 102 preferably is fabricated with one on or more housing walls made of, but not limited to, sheet metal (e.g., aluminum, copper, steel, etc.). In another non-limiting embodiment, the air filtration module 128 of HVAC unit 102 comprises two filters having dimensions of 24 inches by 24 inches. In another non-limiting embodiment, the air purification module 130 of HVAC unit 102 comprises 4 ultraviolet (UV) lights for purifying air within the unit. In another non-limiting embodiment, the air filtration module 128 and the air purification module 130 are positioned at a desired angle between 0 and 90 degrees, with reference to the vertical axis (height) of HVAC unit 102. In various embodiments, air filtration module 128 operates in conjunction with one or more adaptive or interchangeable components of HVAC unit 102. The adaptive or interchangeable components include, but not limited to one or more, return air inlet 104, outside air inlet 106, blower module 108, blower fan 110, outside air inlet damper 112, air freshener module 122, air filtration module 128, air purification module 130, dehumidifying module (disclosed within), cooling module (disclose within), bypass air damper module (disclosed within), and air outlet 132. In various embodiments, the air filtration module 128 comprises a passive filter unit, mechanical filter, polymeric filter, an active filter unit, an active filter unit having sensor and actuators to enable feedback control by a system controller, the like, or combinations thereof. In various embodiments, the filtration module 128 filters the air flowing into, within, through, or air exiting the HVAC unit 102 of infiltrates, VOCs, noxious gas, radon, carbon monoxide, carbon dioxide, particles, pathogens, bacteria, mold, fungi, virus, or the like. In various embodiments, the air purification module 130 operates in conjunction with one or more adaptive or interchangeable components of HVAC unit 102. The adaptive or interchangeable components includes, but not limited to one or more, return air inlet 104, outside air inlet 106, blower module 108, blower fan 110, outside air inlet damper 112, air freshener module 122, air filtration module 128, air purification module 130, dehumidifying module, cooling module, bypass air damper module, and air outlet 132. In various embodiments, the air purification module comprises a passive purification unit (e.g. filter), an active purification unit (e.g., UV), an active purification unit having sensors and actuators to enable feedback control by a system controller, or combinations thereof. In various embodiment, the active purification unit contains emitters capable of emitting non-ionizing or ionizing radiation, electromagnetic radiation, ultrasound, chemical, sono-chemical, gas, mists, photo-ionizing radiation, the like, or combinations thereof, to disinfect the air flowing into, within, through, or air exiting the HVAC unit 102. In various embodiments, the emitters contain sensors and actuators to enable feedback control by a system controller. In various embodiments, the purification unit neutralizes or cleans the said air of infiltrates, VOCs, noxious gas, radon, carbon monoxide, carbon dioxide, pathogens, bacteria, mold, fungi, virus, or the like.

Figure 3:
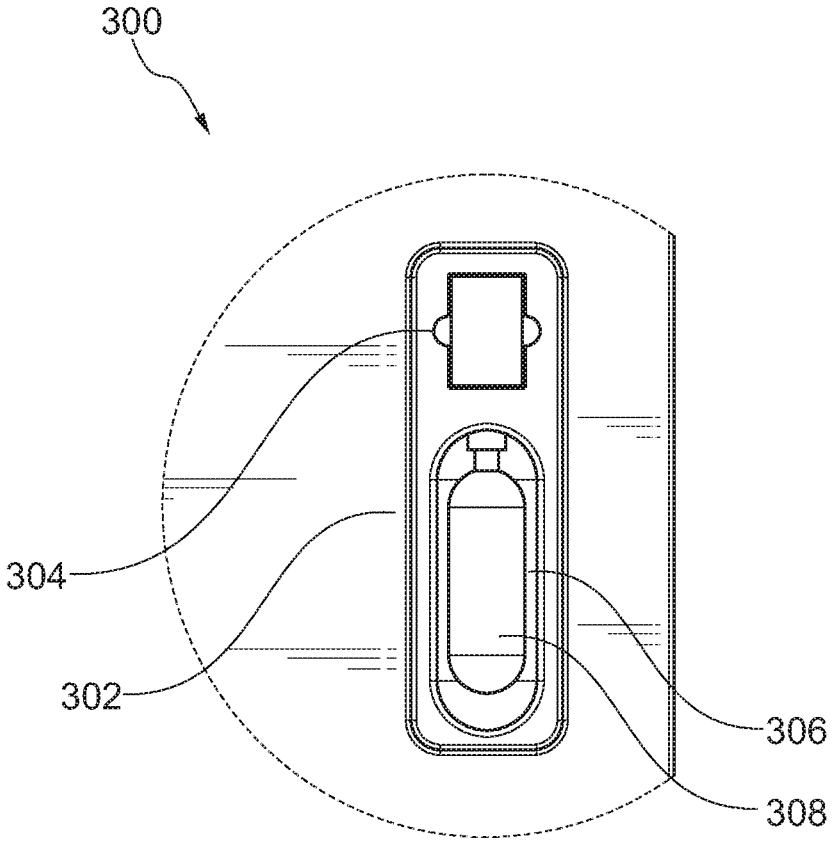
FIG. 3 is a functional diagram showing the details of an air freshener module incorporated within the HVAC unit, according to an embodiment.

Referring now to FIG. 3, a functional diagram showing the details of the air freshener 302 module incorporated within HVAC unit 102. Air freshener module 302 comprises a replaceable or disposable scent cartridge 304 and a replaceable or disposable active scent dispensing unit 306 having an active scent dispensing propellant cylinder 308. In various embodiments, air freshener module 302 operates in conjunction with one or more adaptive or interchangeable components. The adaptive or interchangeable components include, but not limited to one or more, return air inlet 104, outside air inlet 106, blower module 108, blower fan 110, outside air inlet damper 112, air freshener module 122, air filtration module 128, air purification module 130, dehumidifying module (disclosed within), cooling module (disclose within), bypass air damper module (disclosed within), and air outlet 132. In various embodiments, the air freshener module 302 comprises a passive scent unit, a replaceable scent cartridge 304, an active scent dispensing unit 306, an active scent dispensing propellant cylinder 308, the active scent dispensing unit 306 having sensors and actuators (e.g., O2 gas cylinder, propellant) to enable feedback control by a system controller, or combinations thereof. In various embodiment, the active air freshener module 302 dispenses one or more scents, from one or more, scent source, replaceable scent cartridge 304, into the air flowing into, within, through, or air exiting the HVAC unit 102. In various embodiments, the scent cartridge 304 and scent dispensing unit 306 contain sensors and actuators to enable feedback control by a system controller. In various embodiments, the air freshening module 302 affects the said air, air odor, or the like, to improve IAQ.

Figure 4:
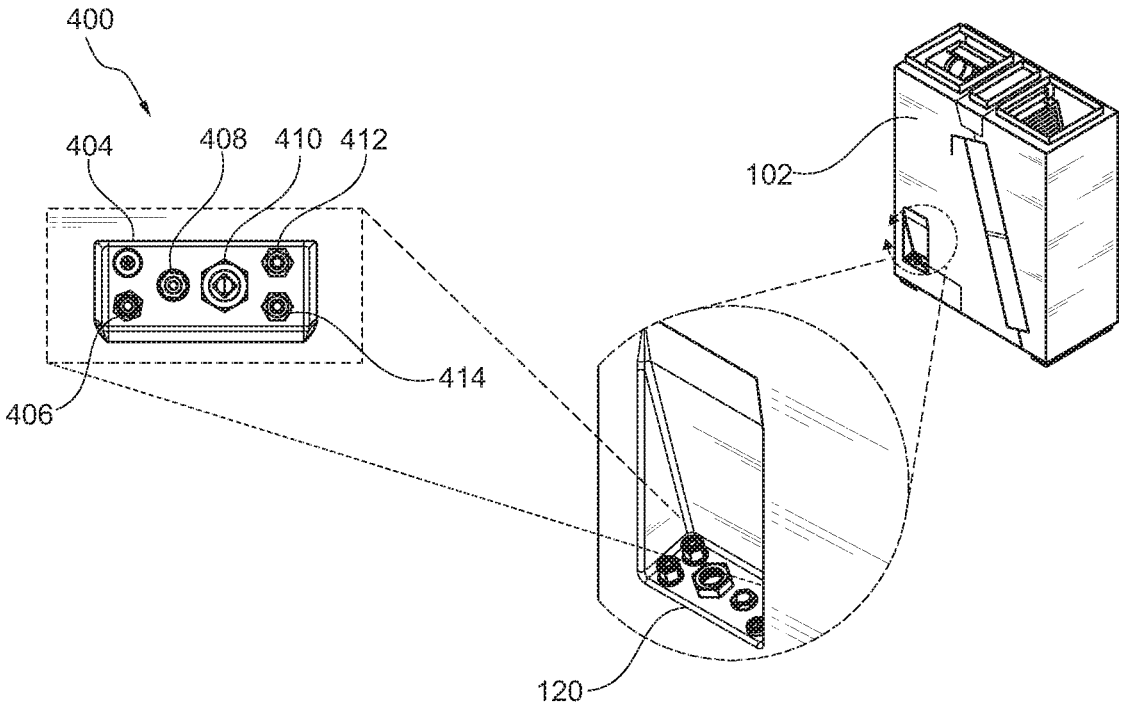
FIG. 4 is a functional diagram showing details of an internal input/output (I/O) panel, according to an embodiment.

Referring now to FIG. 4, a functional diagram illustrating the construction details of the internal input/output (I/O) panel 120 of FIG. 1 is shown. I/O panel 120 comprises one or more water inlet-outlet inputs, refrigerant lines, and voltage inputs. Water inlet 404 allows HVAC unit 102 to be connected to an external water source. Water discharge 406 allows HVAC unit 102 to be connected to an external water discharge sink. Refrigerant lines 408, 410 allows HVAC unit 102 to be connected to an external refrigerant source, preferably a source from an AC thermodynamic circuit that includes additional components, for example, an external compressor, inverter, condenser, valve, thermostatic valve, electronic expansion valve, fan, pump, or the like. High voltage input 412 allows HVAC unit 102 to be connected to a high voltage source. Low voltage input 414 allows HVAC unit 102 to be connected to a low voltage source.

Figure 5:
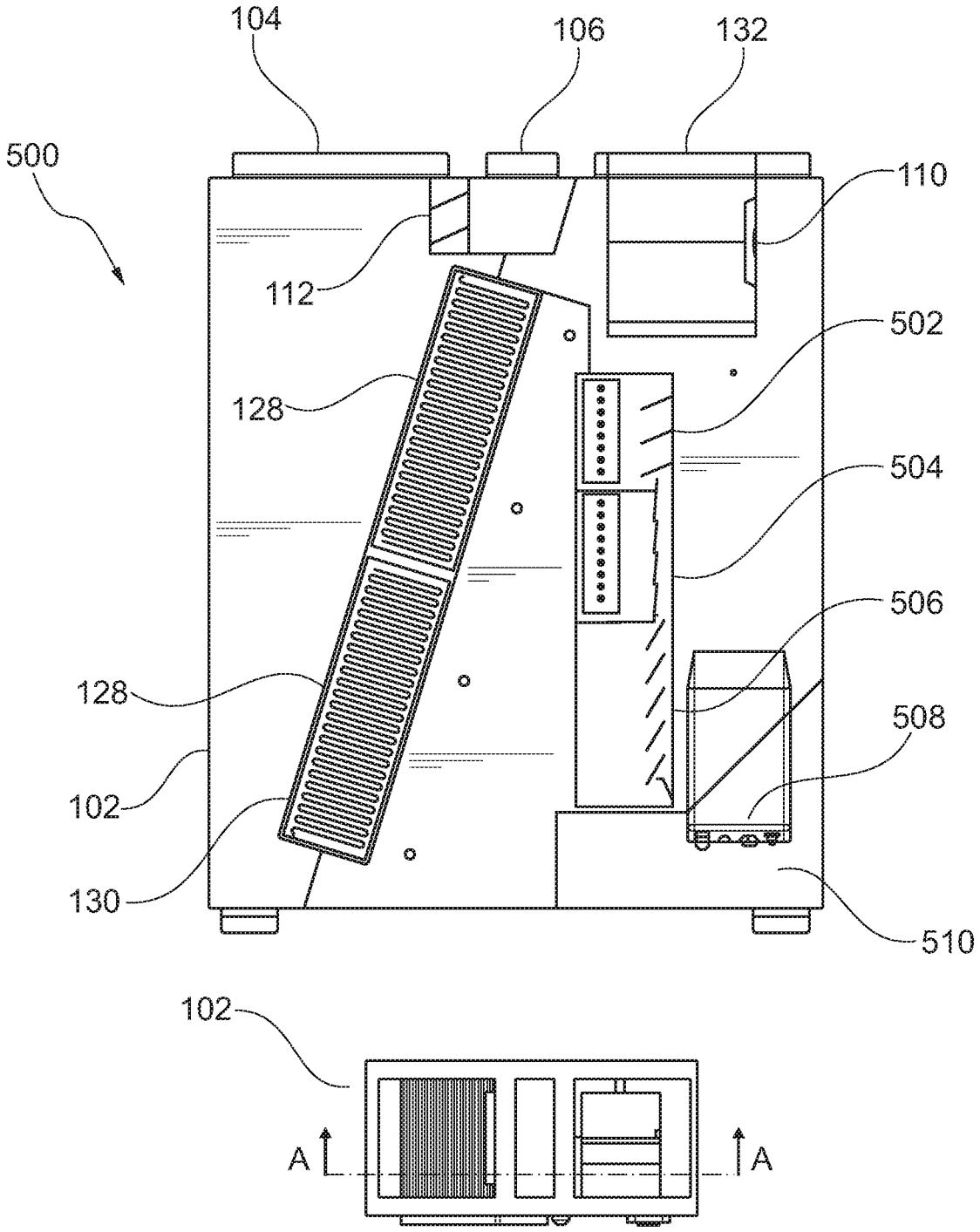
FIG. 5 is a functional diagram showing a cross-section view, exposing the incorporation and placements of additional components and modules within the self-contained, integrated, and modular HVAC unit, according to an embodiment.

Referring now to FIG. 5, a cross sectional diagram exposing the incorporation and placements of additional components and modules within the self-contained, integrated, and modular HVAC unit 102 is shown. In addition to the components disclosed in FIG. 1, HVAC unit 102 incorporates on or more adaptive or interchangeable components, including but not-limited to, dehumidifying module 502, cooling module 504, bypass air damper module 506, utility bulkheads 508, and housing or control cabinet 510. In various embodiments, the dehumidifying module 502 comprises a dehumidifying coil and dehumidifying coil damper operating together within an insertable-removable module. Dehumidification module 502 operates in conjunction with one or more adaptive or interchangeable components to change or maintain humidity (RH) in the conditioned space at a desired level. The adaptive or interchangeable components includes, but not limited to one or more, return air inlet 104, outside air inlet 106, blower module 108, blower fan 110, outside air inlet damper 112, air freshener module 122, air filtration module 128, air purification module 130, cooling module 504, bypass air damper module 506, and air outlet 132. In various embodiments, the cooling module 504 comprises a cooling coil and cooling coil damper operating together within an insertable-removable module. The cooling module 504 operates to modulate the temperature of the airflow, operating in conjunction with one or more adaptive or interchangeable components to establish a specified total cooling capacity (sensible plus latent) to meet variable loads, or to adjust SHR to meet a variable latent ratio, or change or maintain humidity (RH) of a conditioned space. The adaptive or interchangeable components includes, but not limited to one or more, return air inlet 104, outside air inlet 106, blower module 108, blower fan 110, outside air inlet damper 112, air freshener module 122, air filtration module 128, air purification module 130, dehumidification module 502, bypass air damper module 506, and air outlet 132. In various embodiments, the bypass air damper module 506 comprises an air bypass and damper operating together within an insertable-removable module. The bypass air damper module 506 functions to modulate the temperature of the airflow, operating in conjunction with one or more adaptive or interchangeable components to establish a specified total cooling capacity (sensible plus latent) to meet variable loads, or to adjust SHR to meet a variable latent ratio, or change or maintain humidity (RH) of a conditioned space. The adaptive or interchangeable components includes, but not limited to one or more, return air inlet 104, outside air inlet 106, blower module 108, blower fan 110, outside air inlet damper 112, air freshener module 122, air filtration module 128, air purification module 130, dehumidification module 502, cooling module 504, and air outlet 132. In various embodiments, the said modules 502, 504, 506 are exchangeable to meet a desired airflow capacity requirement or enable performance matching with one or more internal or external compressor, inverter, condenser, valve, thermostatic valve, electronic expansion valve, fan, pump, or the like components of an AC thermodynamic circuit. The individual modules 506, 508, 510 are insertable-removable into and out of one or more designated slot, rack, space, location, or the like within the modular HVAC unit 102. The individual modules can be serially connected to one another or may be arranged to function in parallel to facilitate airflow, into, through, within, or out of their inlet or outlet port, structure, or the like, dependent on their individual function. The components are configured to operate as an inter-connected modular system enabling the modulation of the total cooling capacity (sensible plus latent) to meet variable loads and to adjust SHR to meet a variable latent ratio of a conditioned space. In a preferred embodiment, the system modulates the total airflow in response to a relative humidity (RH)-set point of said conditioned space. In another preferred embodiment, the system enables the adjustment of airflow to achieve low sensible heat ratio (SHR) values of said condition space. In various embodiments, the said modules 502, 504, 506 contain sensors (e.g., temperature, pressure, humidity, position, etc.) and actuators (e.g., motors) to enable feedback control by one or more system logic controller. In various embodiment, the dehumidification coil and damper of module 502 operate together under feedback control enabling variable damper position, angle, rotation, to control volumetric airflow over the dehumidification coil. In various embodiment, the cooling coil and damper of module 504 operate together under feedback control enabling variable damper position, angle, rotation, to control volumetric airflow over the cooling coil. In various embodiment, the air bypass damper of module 506 operates under feedback control enabling variable damper position, angle, rotation, to control volumetric airflow over the air bypass space/volume. In various embodiments, the modular HVAC unit 102 operates under a programmable master controller allowing a user to determine a chosen RH set-point, airflow, temperature, or the like, of a condition space. In various embodiments, the said modules 502, 504, 506 are exchangeable to meet a desired airflow capacity requirement or enable performance matching with one or more internal or external compressor, inverter, condenser, valve, thermostatic valve, electronic expansion valve, fan, pump, heat pump, or the like components of an AC thermodynamic circuit. In various embodiments, the output of HVAC unit 102 may be ducted into a condensing water heater, to extract the heat for energy recovery and used as supplemental water heating, within a water heating system.

Figure 5B:
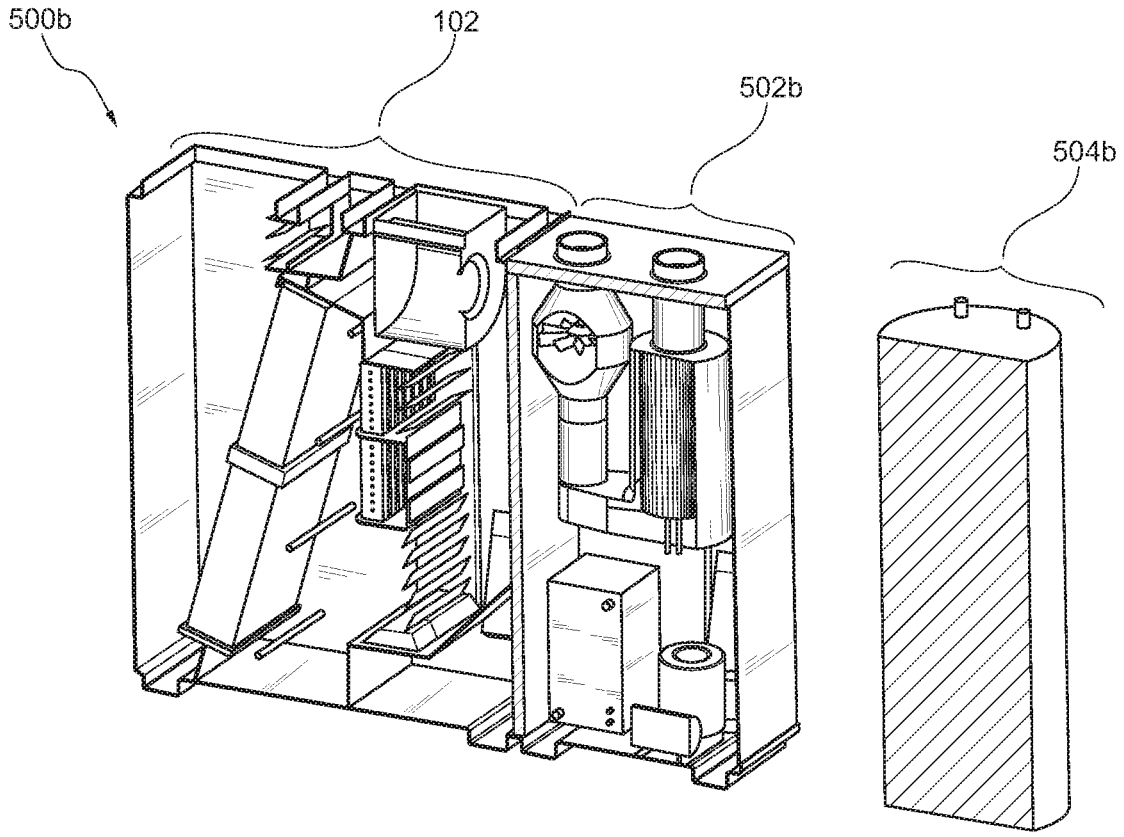
FIG. 5*b* is an illustration of HVAC unit configured to function in combination with a compressor unit and a conventional water heater, according to an embodiment.
Figure 5C:
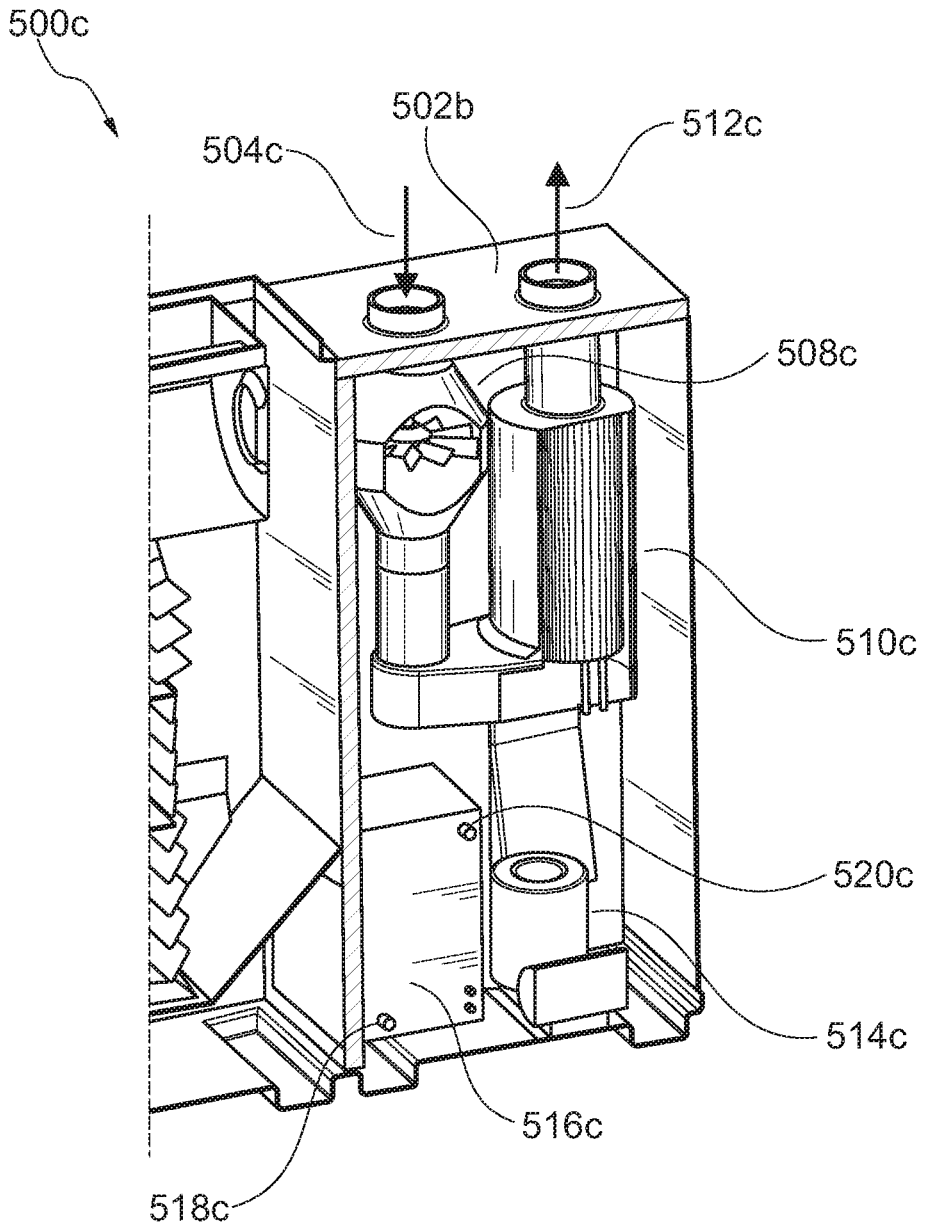
FIG. 5*c* is an illustration of a compressor unit used for energy recovery, according to an embodiment.

In various embodiments, the output of HVAC unit 102 may operate in conjunction on or more external compressor unit or conventional water heater. Referring now to FIG. 5*b*, illustration 500*b* shows HVAC unit 102 can be configured to function in combination with a compressor unit 502*b* and a conventional water heater 504*b*. In an embodiment, the compressor unit 502*b* is preferably configured for energy recovery. Now referring to FIG. 5*c*, illustration 500*c* shows several aspects of the energy recovery method. Compressor unit 502*b* comprises an air inlet 504*c* allowing outside air to be drawn and flow directed by axial fan 508*c* to and through a heat exchanger portion 510*c* and subsequently outside of the unit through air outlet 512*c*. Compressor unit 502*b* comprises also a compressor 514*c* operating to control the state (e.g., gas, liquid) of refrigerant of the AC system and a water circulating unit 516*c*. Water circulating unit 516*c* enables energy recovery to occur whereby water from water heater 504*b* can be introduced into unit 516*c* via inlet 518*c* for thermal siphoning to occur and subsequently flow out of the unit via outlet 520*c* and back to water heater 504*b*. Therefore, the extracted heat is collected and the energy used to supplement the heating of water of unit 504*b*.

In various embodiments, the coils of said dehumidifying and cooling modules comprises non-limiting characteristics, designs, and dimensions. These non-limiting characteristics, designs, and dimensions include: Face Area ($Ft^2$/Ton), Fin Density (Fin/Inch), number of tube rows, inner tube surface, and Fin Type. In various embodiments, the Face Area can be in the range of 0.75 to 1.0, 1.3 to 1.8, or 1.4 to 1.9, or 1.4 to 3.0. In various embodiments, the Fin Density can be in the range of 10-12, 14-16, or 12-17. In various embodiments, the number of tube rows can be 2, 3, or 2 and 3. In various embodiments, the inner tube surface can be smooth or grooved. In various embodiments, the fin type can be corrugated, flat, or lanced. In various embodiments, the coil operates in conjunction with one or more expansion devices, including but not limited to, capillary tube, piston, or thermal expansion valves (TXV), or the like. In a preferred embodiment, TXV provides variable refrigerant metering, enhances system cyclic performance, improves refrigerant control, limits off-cycle refrigerant migration to the compressor, consistent flow of superheated refrigerant back to the external compressor throughout various operating conditions.

Figure 6:
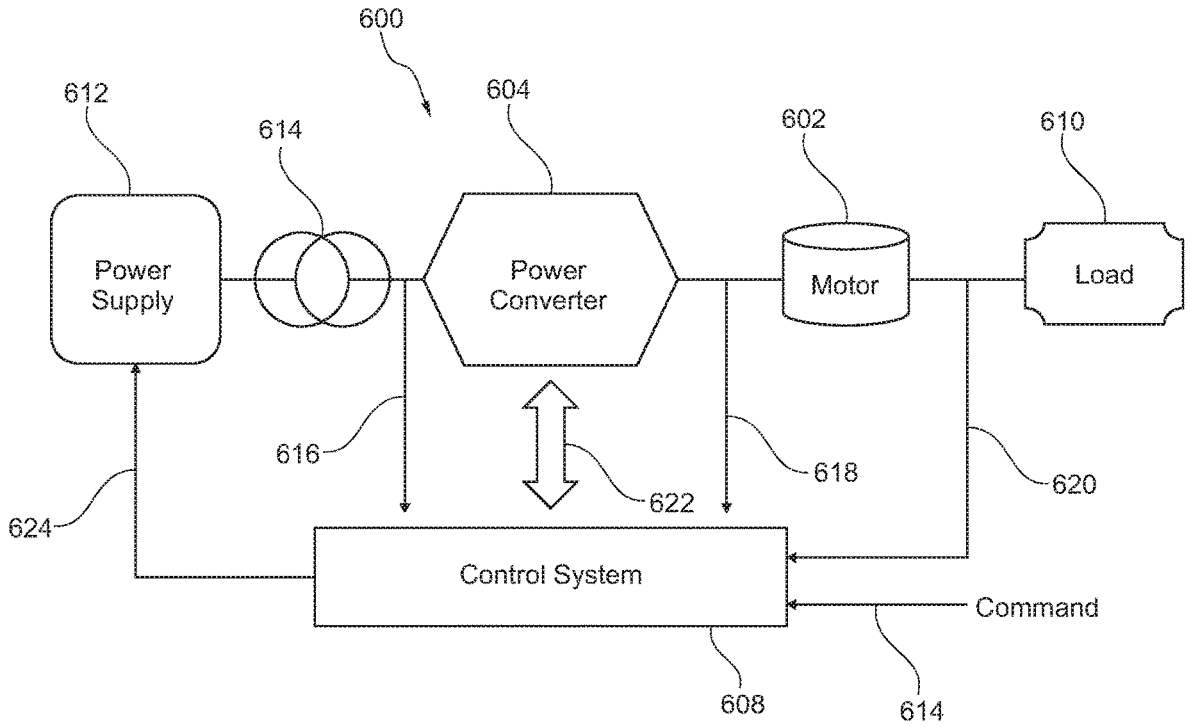
FIG. 6 is a system diagram demonstrating the general principle and components of a variable speed drive system, according to an embodiment.

An object of the present disclosure is a self-contained, integrated, and modular HVAC unit 102 comprising electronic hardware to enable the system, said adaptive or interchangeable components, modules, or sub-unit, sensor, actuator (e.g., motor), damper, blower, or the like, to operate under variable speed drive (VSD), whereby the speed of one or more actuator or motor is regulated to match its speed with a related or total conditioned space load requirement. In conventional AC systems, most motors operate only at full speed 100% for short periods of time. This frequently results in many AC systems operating inefficiently during long periods of time. Therefore, there are significant energy losses during the operation time. According to affinity laws, for pumps, fans, and compressors, the relationship between speed and power is such that a 10% reduction in speed generally results in 30% reduction in power. In a preferred embodiment, HVAC unit 102 comprises one or more VSDs to improve productivity and increase energy efficiency. Referring to FIG. 6, a system diagram demonstrating the general principle and components of a variable speed drive system 600 is shown. Variable speed drive system 600 comprises an electric motor 602, a power inverter 604, and a control system 608. The electric motor 602 generally is connected to a load 610. The power converter 604 controls the power flow from a power supply 612 often via a supply transformer 614. Control system 608 carries out command input 614 (e.g., speed, revolution per minute, frequency, etc.) in conjunction with power feedback signal 616, power converter feedback signal 618, and speed reference signal 620 from load 610, to control power converter 604 via bi-directional connection or circuit 622 and to regulate/control power supply 612 via connection or circuit 624. In various embodiments, power converter 604 operates as an inverter that generates an AC signal by sequentially switching a DC in alternate directions through the load 610. The VSD system 600 enables the motor 602 to operate at speeds other than the fixed-speed that is determined by the AC line frequency (60 Hz in North America) from power supply 612 and the number of motor poles and or magnets. This is achieved by modifying the frequency and voltage input to the motor 602 using power converter 604. In various embodiments, the transformer 614 and power converter 604 uses a rectifier to convert an AC line input to DC. A diode bridge or power transistor then modulates the DC output to simulate an AC-like waveform with the frequency and voltage (or current) desired for the motor application (e.g. fan, etc.). In various embodiments, power transistors use pulse-width modulation (PWM) to create the output waveform by switching the DC supply ON and OFF. In various embodiments, the VSD system changes the duration of the pulse to approximate a sinusoidal waveform for smooth operation. During the ON phase of the pulsation, energy is stored in the motor windings as an inductance and is released during the OFF phase. This configuration ensures that uninterrupted current is supplied to the motor. In a preferred embodiment, the power supply 612 is a DC power supply to negate the need for AC to DC conversion, to reduce energy loss. The DC supply source includes but not limited to, a high voltage DC, photo-voltaic (PV), solar panels, batteries, or the like. In various embodiments, the transformer 614 and power converter 604 may incorporate the use of one or more charge controller and batteries when powered by a PV power source. In various embodiments, the VSD system 600 operates having one or motors, including but not limited to, single-phase AC induction, three-phase induction, shaded-pole, capacitor start induction run (CSIR), capacity start capacitor run (CSCR), series-wound commutated, permanent magnet, electronically commutated, permanent split capacitor, brushless DC motor, or the like. In various embodiments, the load 610 comprises one or more, motor, pump, fans, internal fan of HVAC unit 102, internal compressor of HVAC unit 102, blower of HVAC unit 102, external blower, or external compressor, internal/external heat, or the like. In various embodiments, the HVAC unit 102 comprises at least one VSD system 600 to match the speed of one or more said actuator or motor 602 with a related conditioned space load requirement. The VSD system 600 include but not limited to inverter drives, adjustable speed drives, variable speed drive, variable frequency drive, or vector control drives, or the like. In various embodiments, the VSD system 600 incorporates analog or digital circuits to enable variable speed, linear or rotation, operation of motor 602 with the goal to enhance energy efficiency. In various embodiments, the compressor operating in conjunction with the HVAC unit 102 can be powered by alternative current (AC) or direct current (DC), preferably DC to reduce power conversion loss, enhance energy efficient, as well as using PV to support sustainability. Energy usage reduction through improved efficiency and use of renewable energy employing DC compressors is an advantage of the system of the present invention. In a preferred embodiment, the motor 602 or operating pumps, fans, or compressors of the invention functions at lower variable speeds for longer periods leading to reduce total energy consumption.

Figure 7:
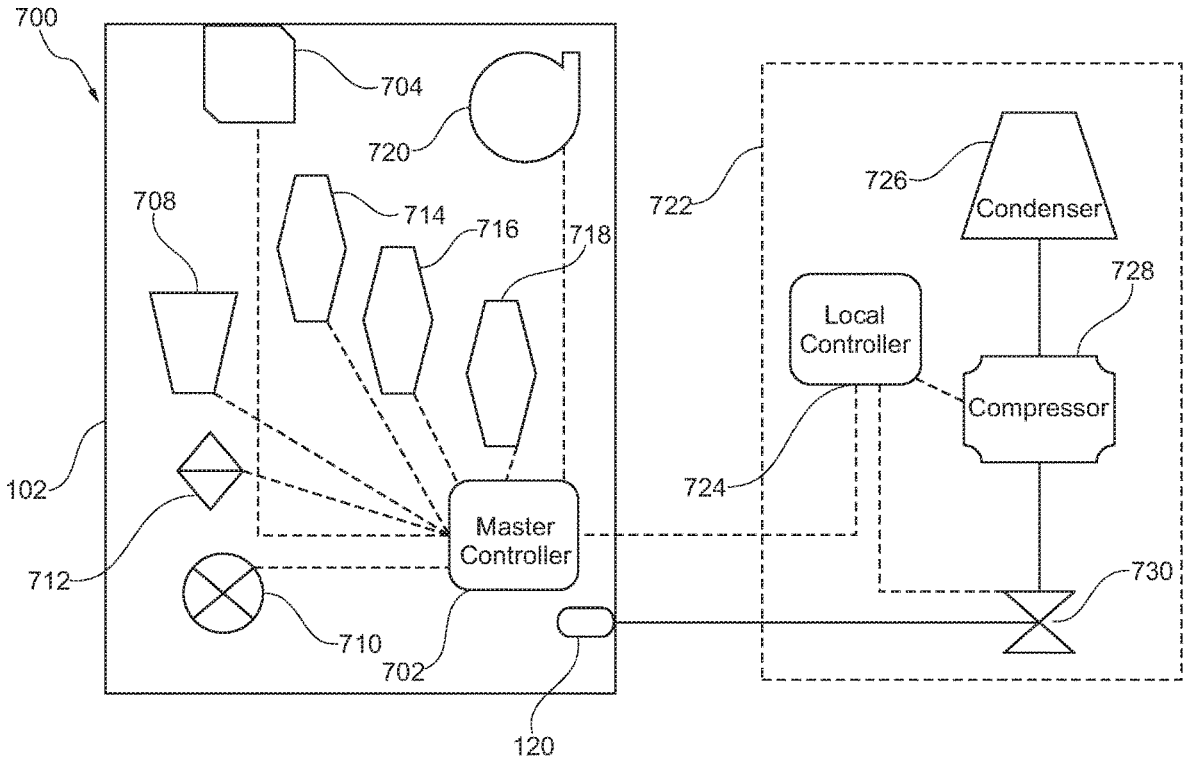
FIG. 7 is a functional diagram of an electronic control system of HVAC unit, according to an embodiment.

Referring now to FIG. 7, an illustration 700 of an electronic control system of HVAC unit 102 is shown. The electronic control system comprises hardware and software components configured to enable feedback control, within a master programmable controller 702. The master controller 702 is electronically connected (illustrated as dashed lines) to one or more adaptive or interchangeable components, modules, or sub-unit, sensor, actuator (e.g., motor) of HVAC unit 102. In this non-limiting illustration, master controller 702, sends-receives signals to-from a sensor or a motor of at least one component to coordinate the operations of HVAC unit 102. In various embodiments, the master controller 702 sends-receives signals to-from sensors and motors of each component, individually, sequentially, or concurrently. In various embodiments, master controller 702 sends-receives signals to-from a motorized air inlet damper 704. In various embodiments, master controller 702 sends-receives signals to-from an active air filtration module 708. In various embodiments, master controller 702 sends-receives signals to-from an active air purification module 710. In various embodiments, master controller 702 sends-receives signals to-from an active air scent dispensing module 712. In various embodiments, master controller 702 sends-receives signals to-from sensors and motors to control dehumidification module 714, or cooling module 716, or air bypass damper module 718. In various embodiments, the dehumidification, cooling, and air bypass modules contain sensors (e.g., temperature, pressure, humidity, position, etc.) and actuators (e.g., damper) to enable feedback control by master controller 702. In various embodiments, master controller 702 sends-receives signals to-from blower module 720. Master controller 702 may coordinate the operation of one or more external components 722, through a local controller 724, connected to complete an AC thermodynamic cycle or engine, with a condenser 726, a compressor 728, and an expansion valve 730, via refrigerant lines 408, 410. In a similar manner, local controller 724 is electronically connected (illustrated as dashed lines) to one or more said external components 722. In various embodiments, master controller 702 sends-receives signals to-from local controller 724 to coordinate operation with a compressor 726, or an electronic thermal expansion valves (TXV) 730, individually, sequentially, or concurrently. In various embodiments, external components 722 may be incorporated within HVAC unit 102 as one complete unit. In this case, master controller 702 may directly control compressor 728 or TXV 730. In various embodiments, master controller 702 controls a variable speed compressor 728 together with TXV 730 to improve the system performance and energy efficiency.

In various embodiments, the control logic may be configured using hardware electronic components. In one embodiment, the control logic may be configured as a set of instructions executable by the at least one of the one or more processors and stored using a non-transitory computer readable medium. The feedback control logic or methods employed by controller 702 include, but not limited to, classic, modern, and intelligent methods. In various embodiments, the classic methods include on-off, proportional-integral (PI), proportional-integral-derivative (PDI), or the like. In various embodiments, the classic methods include adaptive and optimal, or the like. In various embodiments, the intelligent methods include fuzzy logic and neural network, or the like. In various embodiments, the method is a stochastic optimal control method or the like. In various embodiments, the method is a nonlinear and adaptive control method or the like. In various embodiments, the method is a modern MIMO (multiple input-multiple output) control method or the like. In a preferred embodiment, the electronic controller 702 enables the modulation of the total cooling capacity (sensible plus latent) to meet variable loads and to adjust SHR to meet a variable latent ratio of a conditioned space. In another preferred embodiment, the electronic controller 702 enables HVAC unit 120 to modulates the total airflow in response to a relative humidity (RH)-set point of said conditioned space. In yet another preferred embodiment, the control system enables the adjustment of airflow to achieve low sensible heat ratio (SHR) values of said condition space.

Figure 7B:
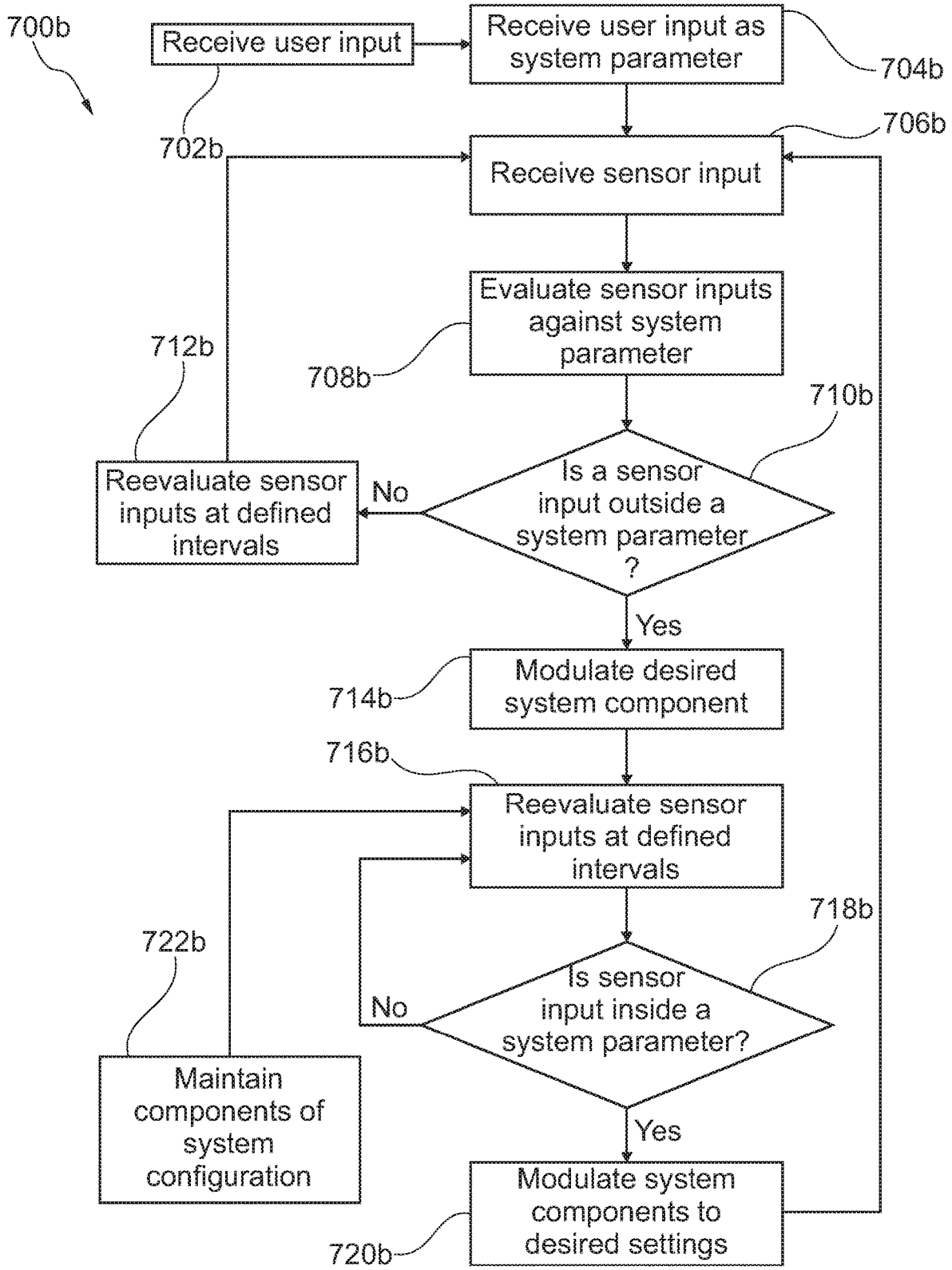
FIG. 7*b* is a functional block diagram of a control logic executable using an electronic control system of the HVAC unit, according to an embodiment; and, FIG. 8 is a functional diagram of an additional aspect of an electronic control system of HVAC unit, according to an embodiment.

Referring now to FIG. 7*b*, a functional block diagram 700*b* of the control logic for one or more device under feedback control by master controller 702. User input (e.g., RH-set point) is received 702*b* and the user input is defined as a system parameter 704*b*. Sensor inputs are received 706*b* from one or more said device of FIG. 7 and the resulting data is evaluated against the system parameters 708*b*. A decision is made as to whether or not a sensor input is outside a system parameter 710*b*. If "NO," no action is taken and the sensor input is reevaluated at defined intervals 712*b*. If "YES," a desired system component is modulated 714*b* to bring the sensor input from the conditioned space within the system parameters. For example, system cooling may be initiated or blower speed may be increased or decreased using a said VSD. Once modulation is started, the sensor inputs from the conditioned space are reevaluated at defined intervals 716*b* to evaluate if the sensor input is within the system parameters 718*b*. If "NO," the desired system configuration is maintained 722*b*, or the system continues to proportionally modulate components until the sensor inputs from the conditioned space fall within the desired parameters. Sensor inputs are reevaluated at defined intervals 716*b* in a continuous feedback loop until the sensor inputs fall within the system parameters. If "YES," sensor inputs from the conditioned space fall within the system parameters, the system monitors the inputs and modulates components to maintain the achieved desired settings 720*b*. The system again reevaluates sensor inputs at defined intervals 716*b* and compares the input to the system parameters, this feedback loop continues until the sensor input falls out of the system parameters or a new user input 702*b* is received to reinitiate the process.

In various embodiments, the master controller 702 comprises hardware and software components configured to enable diagnostic feedback from motorized damper 704, air filtration module 708, air purification module 710, air freshener module 712, dehumidification module 714, cooling module 716, bypass air damper module 718, and blower module 720, internal or external compressor 728, electronic expansion valve 730, or the like, using one or more diagnostic sensor. In various embodiments, the electronic controller 602 enables the monitoring of one or more said device to determine operating parameters, set operating parameter, configure functions, for trouble-shooting, setting alerts, determine operating efficiency, tuning, or the like.

Figure 8:
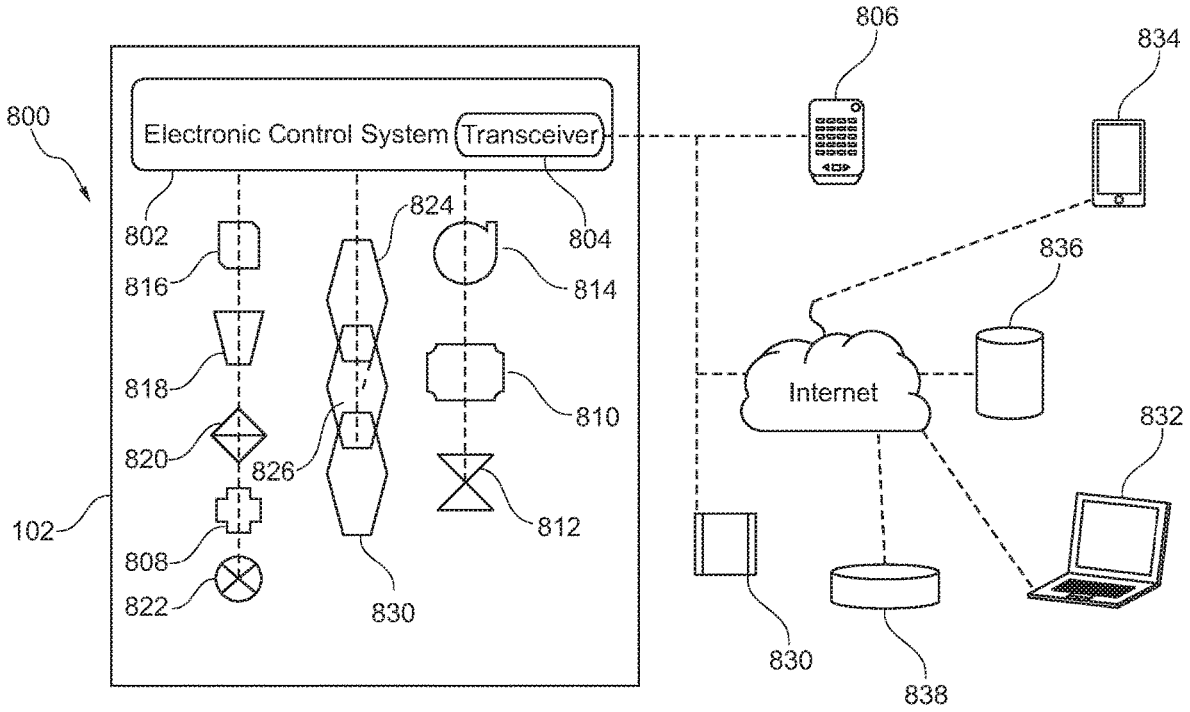

Referring now to FIG. 8, an illustration 800 of another aspect of an electronic control system of HVAC unit 102 is shown. The HVAC unit 102 has a control cabinet comprising an electronic control system 802 comprising an electronic data communication module. The communication module contains one or more electronic components, including a wireless transceiver 804, to enable the transmission or reception of data from, for example, an internal or external/remote controller 806; sensor/actuator 808, inverter-compressor 810, electronic expansion valve 812, blower 814, damper 816, air filtration module 818, air scent dispenser module 820, air purification module 822, dehumidification module 824, cooling module 826, air bypass module damper 828, a remote thermostat 830, computer/laptop 832, computing mobile device/mobile phone 834, cloud server 836, or the like. In various embodiments, transceiver 804 comprises one or more hardware-software-I/O unit (e.g., circuit, chip, device, protocol, application, etc.) to enable Ethernet, RF, Wi-Fi®, Bluetooth®, BLE, or Internet of Things operation for data communication. In various embodiments, the control system 802 accepts one or more input relating to the environment settings of a condition space from an external, remote, or wireless controller 806, thermostat 830, computing device 832, smart mobile device (e.g., phone) 834, cloud server 836, or the like. In various embodiment transceiver 804 sends and receives data relating to environmental settings of a condition space using said hardware and software data communication means (illustrated as dotted-lines) via local area network (LAN), local wireless, wide-area wireless, cellular, intranet, Internet, or the like. In various embodiments, the controller 806 provide computing memory storable options for configuring the conditioned space with the non-limiting following parameters: temperature, humidity (RH), airflow, operation schedule (e.g., time of the day, duration of operation), efficiency setting, scent-type, scent cartridge, filtration unit operation schedule, purification unit operation schedule, system diagnostic parameters, component information (e.g., brand, manufacturer, operational parameters, etc.), or the like. In various embodiments, the inputs for the environment settings may be sent to the HVAC control system 802 using a computing application software, stored in, for example; remote control 806, computing device 832, smart mobile device 834, smart thermostat 830, or cloud server 836. In various embodiment, the application software may execute instructions on a computing system, a computing device (e.g., device 832), computing mobile device, mobile phone, smart mobile phone (e.g., device 834), mobile app, cloud server (e.g., device 836), or the like. In various embodiments, the control system 802 may communicate and function with external environment management control system 838, via for example, the Internet, intranet, short wireless, wireless, a LAN, a WAN, wireless cellular network, or the like.

The present disclosure includes that contained in the appended claims as well as that of the foregoing description. Although this invention has been described in its exemplary forms with a certain degree of particularity, it is understood that the present disclosure of has been made only by way of example and numerous changes in the details of construction and combination and arrangement of parts may be employed without departing from the spirit and scope of the invention. The terms and expressions which have been employed in the foregoing description are used therein as terms of description and not of limitation, and there is no intention in the use of such terms and expressions to exclude equivalents of the features shown and described or portions thereof, it being recognized that the scope of the invention is defined and limited only by the claims which follow.

What is claimed is:

1. An adaptive modular HVAC system comprising:

a housing having a first compartment, a second compartment, and an interface extending between the first compartment and the second compartment, the first compartment defining a return air plenum and the second compartment defining a supply air plenum;

a cooling module removably coupled to a first portion of the interface, the cooling module defining a first airflow path, the cooling module having a first cooling coil and a first motorized damper;

a dehumidification module removably coupled to a second portion of the interface, the dehumidification module defining a second airflow path, the dehumidification module having a second cooling coil and a second motorized damper;

an airflow bypass module removably coupled to a third portion of the interface, the airflow bypass module defining a third airflow path, the airflow bypass module having a third motorized damper;

a blower coupled to an upper portion of the second compartment of the housing;

a plurality of sensors comprising at least one temperature sensor and at least one humidity sensor; and a controller operably engaged with the first motorized damper, the second motorized damper, the third motorized damper, and the blower, wherein the controller is configured to modulate a position of each of the first motorized damper, the second motorized damper and the third motorized damper in response to an input from one or both of the at least one temperature sensor and the at least one humidity sensor, and dynamically regulate a fan speed of the blower.

2. The system of claim 1 wherein the first motorized damper is variably configured between an open position and a closed position.

3. The system of claim 1 wherein the second motorized damper is variably configured between an open position and a closed position.

4. The system of claim 1 wherein the third motorized damper is variably configured between an open position and a closed position.

5. The system of claim 1 further comprising an air freshener module coupled to a portion of the first compartment of the housing, the air freshener module comprising a scent dispensing unit and a scent propellant cylinder.

6. The system of claim 1 further comprising an air purification module coupled to a portion of the first compartment of the housing, the air purification module comprising a passive purification unit and an active purification unit.

7. The system of claim 1 further comprising an air filtration module coupled to a portion of the first compartment of the housing, the air filtration module comprising a passive filtration unit and an active filtration unit.

8. The system of claim 1 further comprising an outside air inlet extending between an exterior surface and an interior surface of the first compartment of the housing, the outside air inlet having an outside air inlet damper.

9. An adaptive modular HVAC system comprising:

a housing having a first compartment, a second compartment, and an interface extending between the first compartment and the second compartment, the first compartment defining a return air plenum and the second compartment defining a supply air plenum;

a cooling module removably coupled to a first portion of the interface, the cooling module defining a first airflow path, the cooling module having a first cooling coil and a first motorized damper;

a dehumidification module removably coupled to a second portion of the interface, the dehumidification module defining a second airflow path, the dehumidification module having a second cooling coil and a second motorized damper;

an airflow bypass module removably coupled to a third portion of the interface, the airflow bypass module defining a third airflow path, the airflow bypass module having a third motorized damper;

a blower coupled to an upper portion of the second compartment of the housing, the blower comprising a first variable speed drive, the first variable speed drive comprising an electric motor, a power inverter, and a controller operably engaged with the first motorized damper, the second motorized damper, the third motorized damper, and the blower, wherein the controller is configured to modulate a position of each of the first motorized damper, the second motorized damper and the third motorized damper in response to one or both of a temperature sensor input and a humidity sensor input, and dynamically regulate the first variable speed drive.

10. The system of claim 9 further comprising a compressor unit operably engaged with the first cooling coil and the second cooling coil, the compressor unit comprising a compressor, a condenser, and a thermal expansion valve.

11. The system of claim 10 wherein the compressor unit further comprises a second variable speed drive, the second variable speed drive comprising an electric motor, a power inverter, and a controller, the controller being configured to dynamically regulate an electrical current to the compressor.

12. The system of claim 11 further comprising one or more batteries operably engaged with the first variable speed drive of the blower and the second variable speed drive of the compressor unit.

13. The system of claim 9 wherein the first motorized damper is variably configured between an open position and a closed position.

14. The system of claim 9 wherein the second motorized damper is variably configured between an open position and a closed position.

15. The system of claim 9 wherein the third motorized damper is variably configured between an open position and a closed position.

16. An adaptive modular HVAC system comprising:

a housing having a first compartment, a second compartment, and an interface extending between the first compartment and the second compartment, the first compartment defining a return air plenum and the second compartment defining a supply air plenum;

a cooling module removably coupled to a first portion of the interface, the cooling module defining a first airflow path, the cooling module having a first cooling coil and a first motorized damper;

a dehumidification module removably coupled to a second portion of the interface, the dehumidification module defining a second airflow path, the dehumidification module having a second cooling coil and a second motorized damper;

an airflow bypass module removably coupled to a third portion of the interface, the airflow bypass module defining a third airflow path, the airflow bypass module having a third motorized damper;

a blower coupled to an upper portion of the second compartment of the housing, the blower comprising a first variable speed drive, the first variable speed drive being configured to dynamically regulate an electrical current to an electric motor;

a compressor unit operably engaged with the first cooling coil and the second cooling coil, the compressor unit comprising a compressor, a condenser, a second variable speed drive, and a thermal expansion valve, the second variable speed drive being configured to dynamically regulate an electrical current to the compressor;

a plurality of sensors comprising at least one temperature sensor and at least one humidity sensor; and, a controller operably engaged with the first motorized damper, the second motorized damper, the third motorized damper, and the blower, and configured to receive a data input from the plurality of sensors, the controller being comprised of one or more processors, and a non-transitory computer readable medium having stored thereon a set of instructions being programmable by a user and executable by at least one of the one or more processors, to cause the at least one of the one or more processors to perform one or more operations comprising:

modulating the position of the first motorized damper in response to a data input from the at least one temperature sensor;

modulating the position of the second motorized damper in response to a data input from the at least one humidity sensor;

modulating the position of the third motorized damper in response to a data input from the at least one temperature sensor and the at least one humidity sensor; and, dynamically regulating the first variable speed drive and the second variable speed drive.

17. The system of claim 16 wherein the controller is selected from the group consisting of a smart phone, a laptop computer, a tablet computer, a smart thermostat, a desktop computer, and a remote server.

18. The system of claim 17 further comprising a remote server communicably engaged with the controller over a communications network, the controller being configured to communicate system data to the remote server, the remote server storing the system data in a database.

19. The system of claim 18 wherein the remote server further comprises application logic configured to display a graphical user interface to a web or mobile browser, the graphical user interface configured to display sensor data and controller settings to a user.

20. The system of claim 17 wherein the plurality of sensors further comprise one or more indoor air quality sensors.

* * * * *